US007360370B2

(12) United States Patent
Shah et al.

(10) Patent No.: US 7,360,370 B2
(45) Date of Patent: Apr. 22, 2008

(54) METHOD OF VERIFYING PROPER INSTALLATION OF A ZONED HVAC SYSTEM

(75) Inventors: Rajendra K. Shah, Indianapolis, IN (US); Christopher M. Puranen, Noblesville, IN (US)

(73) Assignee: Carrier Corporation, Syracuse, NY (US)

( * ) Notice: Subject to any disclaimer, the term of this patent is extended or adjusted under 35 U.S.C. 154(b) by 616 days.

(21) Appl. No.: 10/841,282

(22) Filed: May 7, 2004

(65) Prior Publication Data

US 2005/0159848 A1 Jul. 21, 2005

Related U.S. Application Data

(60) Provisional application No. 60/537,760, filed on Jan. 20, 2004.

(51) Int. Cl.

| | |
|---|---|
| ***F25B 49/00*** | (2006.01) |
| ***F25D 17/02*** | (2006.01) |
| ***F24D 14/10*** | (2006.01) |
| ***F24F 3/00*** | (2006.01) |

(52) U.S. Cl. ..... 62/131; 62/186; 165/205; 236/1 B

(58) Field of Classification Search ..... 62/126, 62/129, 131, 186; 165/205; 236/1 B, 94
See application file for complete search history.

(56) References Cited

U.S. PATENT DOCUMENTS

| | | | | |
|---|---|---|---|---|
| 4,479,604 | A * | 10/1984 | Didner | 236/49.3 |
| 4,843,084 | A | 6/1989 | Parker et al. | |
| 5,179,524 | A | 1/1993 | Parker et al. | |
| 5,495,887 | A * | 3/1996 | Kathnelson et al. | 165/11.1 |
| 2001/0025349 | A1 | 9/2001 | Sharwood et al. | |
| 2006/0186213 | A1* | 8/2006 | Carey et al. | 236/1 B |
| 2006/0249589 | A1* | 11/2006 | Karamanos | 236/49.3 |

FOREIGN PATENT DOCUMENTS

| | | | |
|---|---|---|---|
| EP | 0 660 051 | A2 | 6/1995 |
| GB | 2091453 | A * | 7/1982 |

OTHER PUBLICATIONS

International Search Report, Feb. 8, 2006.

* cited by examiner

*Primary Examiner*—Marc Norman
(74) *Attorney, Agent, or Firm*—Carlson, Gaskey & Olds

(57) ABSTRACT

A method and control is provided wherein the sensors in a plurality of zones are properly associated with the dampers associated for each of the zones after installation. A technician goes to each zone and sends a signal from the sensor, and the control then makes a change at the associated damper. The technician can then ensure the two are properly associated within the control.

6 Claims, 2 Drawing Sheets

METHOD OF VERIFYING PROPER INSTALLATION OF A ZONED HVAC SYSTEM

This application claims priority to provisional patent application Ser. No. 60/537,760, filed Jan. 20, 2004, and entitled "Method of Verifying Proper Installation of a Zoned HVAC System." The disclosure of this provisional application is incorporated herein in its entirety, by reference.

BACKGROUND OF THE INVENTION

This application relates to a method of verifying that the sensors disposed in a plurality of zones in a multi-zone heating, ventilating and air conditioning (HVAC) system are properly associated with corresponding zone dampers.

In a typical ducted HVAC system, a blower in an indoor air handler circulates air to various parts of the home through a system of ducts. In a typical zoned HVAC system, the ducts are divided into several zones, one for each part of the building that is desired to be controlled independently of the other areas. A set of dampers is installed into the ducts, with at least one damper for each zone. These dampers can be opened or closed, to direct more or less air to a particular zone as needed to satisfy the desired comfort level in that zone. Generally, a system control controls the operation of the ducts. A desired comfort level is set as desired room temperature set point for each zone in the home, and as set by the user.

In one prior art system, a user, such as a homeowner, can set this desired room temperature level for each zone at a main user interface or system control, which is also the thermostat of a first zone. Alternatively, set point controls can be placed in each zone.

Each zone has a temperature sensor that measures the actual room temperature in the zone and electrically transmits its value to the system control. The system control then compares the actual temperature in each zone to its respective desired set point. If one or more zones are not at the desired temperature level, the system turns on cooling or heating equipment (as needed) and opens the dampers of those zones. In this manner, cooling or heating capacity is delivered to every zone, as needed, to enable the sensed actual temperature of the zone to match the desired temperature for each zone. In more advanced systems, not only can the dampers be fully opened or closed, but they can also be modulated to a number of positions in between, to achieve a more precise level of comfort control.

As mentioned, zoned HVAC systems have temperature sensors for each zone and, correspondingly, dampers in the duct system that direct temperature conditioned air to each zone. During typical installation, all sensors and all dampers are wired to the system control. Since dampers are in the duct system and sensors are typically on the wall in each zone, it is important that the damper(s) for each zone, as wired, properly correspond to the sensor for the same zone. Otherwise, the zoning system cannot operate properly and maintain desired comfort in all zones. The system control could command a damper to open to correct a particular zone's temperature difference, and would be controlling the damper of the wrong zone.

However, if such a wiring error is made, the comfort problem may not be immediately apparent. Depending on the homeowner's set points and outdoor conditions, some zones may not need any conditioning for long periods of time, and the effects of wiring errors may not be noticed until then. An installer has no easy way to verify proper installation without waiting for the right set of conditions to develop.

The above prior art system does provide a method for verifying proper installation. From the system control, the installer can command the dampers associated with any zone to open. The installer then must go to that zone and verify that air is being delivered from its registers. This method does verify if the damper is operating, but it does not verify if it is responding to the correct sensor. Also this method requires the installer to go back and forth between each zone and the system control.

SUMMARY OF THE INVENTION

Per this invention, the installer can start a zoning installation verification process at the system control, which also functions as the service tool. An input switch is preferably provided at the system control, which may be a main thermostat, that allows the system control to be moved into installation verification mode. The installer then walks to any zone in the home and signals to the system using the zone's temperature sensor. In embodiments, the signaling can be done in several ways depending on the type of sensor in the zone. As an example for a standard temperature sensor, the installer may disconnect one of the two wires at the sensor. For a "Smart Sensor" having input ability, the installer may press a pre-designated key. Of course, other methods can be used.

In either case, the system control now knows that the installer is in a particular zone. The system opens the damper for that zone while closing all others, and runs the indoor air handler to deliver a predetermined amount of airflow. If both the sensor and the dampers for that zone are wired correctly, the installer should feel air coming out of the registers in the zone, otherwise not. The installer than walks to the next zone. Again, after a signal is sent via that zone's sensor, its damper should open, sending airflow to the zone. All zones in the system may be verified in this manner in any order that is convenient.

These and other features of the present invention can be best understood from the following specification and drawings, the following of which is a brief description.

DETAILED DESCRIPTION OF THE PREFERRED EMBODIMENT

Figure 1:
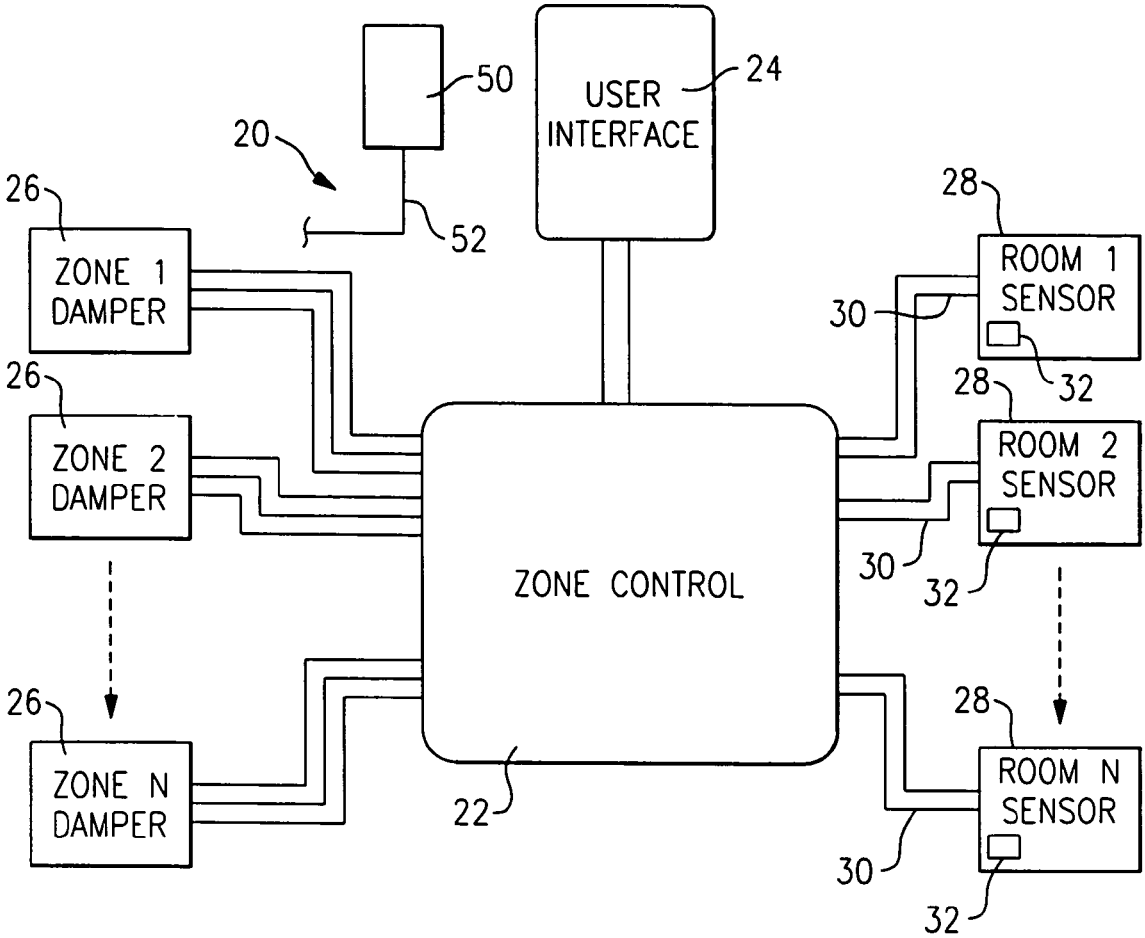
FIG. 1 is a schematic view of an HVAC system incorporating this invention.

A portion of an HVAC system 20 is illustrated in FIG. 1 having a zone control 22 for operating a plurality of dampers 26 associated with each of several zones, and for receiving control information from a plurality of sensors 28 associated with the same plurality of zones. As shown, wires 30 connect the sensors to the zone control 22, and the sensors 28 are illustrated as "smart sensors" each having inputs 32 to allow an operator to set a desired temperature set point, or otherwise provide a signal to the control 22, and ultimately a system control 24. Most preferably, the communication between the various components 26, 28, 24 and 22 is by digital serial communication over control wires such as is disclosed in co-pending U.S. patent application Ser. No. 10/752,626, entitled "Serial Communicating HVAC System," filed Jan. 7, 2004, the entire disclosure of which is incorporated herein by reference.

Figure 2:
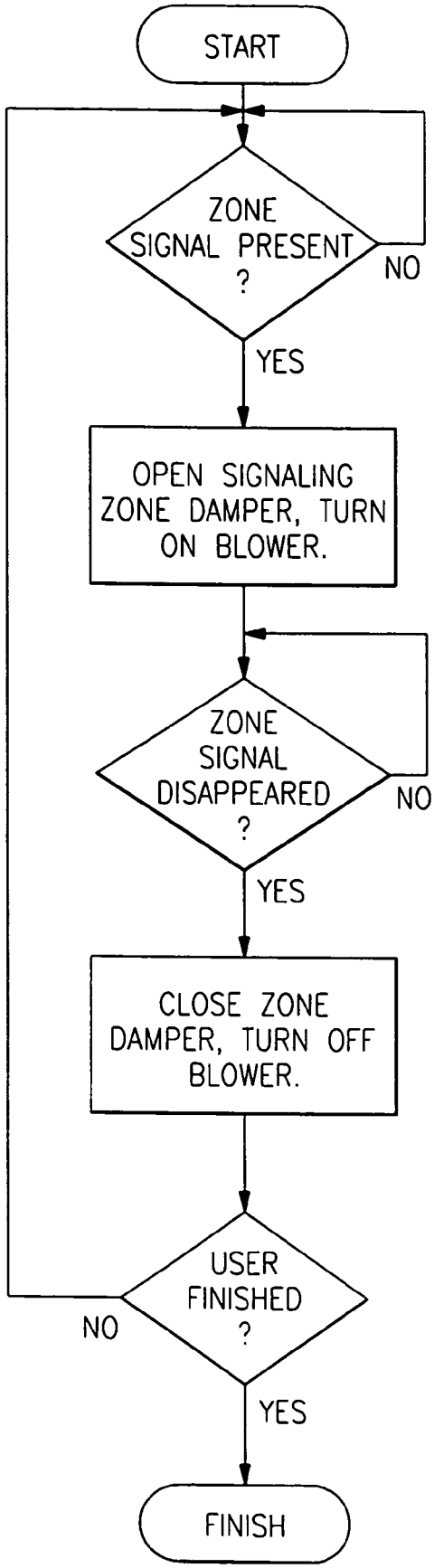
FIG. 2 is a flowchart of the present invention.

As shown in the flowchart of FIG. 2, once the system 20 is initially installed, a technician may go through a verification process for ensuring that the control 24 and control 22 associate each of the dampers 26 and each of the sensors 28 with the proper zones. First, the installer may move the control 24 or the control 26 into an installation verification mode by some method such as actuating a key or switch. Then, the installer will go to a first zone and send a signal to control 24, identifying the signal as coming from the particular zone. The signal may be sent by disconnecting the wire 30, or actuating the input switch 32. Of course, other ways of providing a signal to the control 24 indicative of the particular sensor that is responding can be utilized.

Once control 24 sees that a zone signal is present, the damper associated with that zone is driven to open. The blower 50 associated with the HVAC system is actuated to drive conditioned air through a duct system 52 to the zone with the open damper. The technician, who will be in the zone, can then ensure that the damper is open by checking to ensure that air is being delivered into the zone associated with the sensor he has signaled. In a disclosed embodiment, all dampers associated with the other zones are closed, such that the technician can easily ensure that the appropriate damper has been opened.

The technician will then either send a stop signal through switch 32, reconnect the wire 30, or perform some other way of signaling the control 24 that the first zone has been properly installed.

On the other hand, if the damper 26 in the zone does not open, the technician can determine that some mis-wiring must have occurred. Either the damper 26 or sensor is mis-wired.

Once the zone signal has disappeared, the control 24 then closes the particular zone damper and turns off the blower. The control 24 would then wait for another zone signal to be received. The technician would go from zone to zone, doing a similar process to ensure that the system has been properly installed and the sensors are properly identified with each respective damper.

In the disclosed embodiment, the user interface or system control 24 and zone control 22 are microprocessor controls. System control 24 may be incorporated into a thermostat. Even so, other type controls capable of performing this and other necessary functions may be utilized.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A method of ensuring proper installation of an HVAC system comprising the steps of:

(1) providing an HVAC system including a plurality of zones each having a damper and an associated sensor, and a control associating each of said dampers, with one of said sensors;

(2) moving the control into a verification mode, and sending a signal from one of an associated set of a damper and a sensor at said control, said control then performing a change at the other of said associated sensor and damper to allow a technician to ensure said damper and sensor are proper, as associated within said control;

(3) repeating step (2) at a second zone;

(4) said technician sending a signal from said sensor, and said control changing the position of said damper based upon a receipt of said signal; and (5) said dampers of zones other than said first zone are maintained static during step 2.

2. The method as set forth in claim 1, wherein said dampers of zones other than said first zone are maintained closed during step 2.

3. The method as set forth in claim 1, wherein said signal is sent by said sensor by actuating an input.

4. The method as set forth in claim 1, wherein if the change at the other of said associated sensor and damper is not seen, an identification of a mis-wiring is made.

5. A method of ensuring proper installation of an HVAC system comprising the steps of:

(1) providing an HVAC system including a plurality of zones each having a damper and an associated sensor, and a control associating each of said dampers, with one of said sensors;

(2) moving the control into a verification mode, and sending a signal from one of an associated set of a damper and a sensor at said control, said control then performing a change at the other of said associated sensor and damper to allow a technician to ensure said damper and sensor are proper, as associated within said control;

(3) repeating step (2) at a second zone;

(4) said technician sending a signal from said sensor, and said control changing the position of said damper based upon a receipt of said signal; and (5) said signal being sent from said sensor by disconnecting a wire.

6. An HVAC system comprising:

a plurality of zones each having a damper and an associated sensor, and a control associated with each of said sensors with one of said dampers;

said control being movable into a verification mode at which it receives a signal associated with one of said sensors to indicate a location for an installation check, said control associating said signal from said one of said sensors with a particular damper, and changing the position of said damper to in turn allow a technician to ensure said sensor and said damper are properly associated at said control; and said signal being sent from said sensor by disconnecting a wire associated with said sensor.

* * * * *